US006607614B1

(12) United States Patent
Richardson et al.

(10) Patent No.: US 6,607,614 B1
(45) Date of Patent: Aug. 19, 2003

(54) AMORPHOUS NON-LAMINAR PHOSPHOROUS ALLOYS

(75) Inventors: Rick Alan Richardson, Dayton, OH (US); Daniel A. Brockman, Dayton, OH (US)

(73) Assignee: Techmetals, Inc., Dayton, OH (US)

( * ) Notice: Subject to any disclaimer, the term of this patent is extended or adjusted under 35 U.S.C. 154(b) by 542 days.

(21) Appl. No.: 09/173,456

(22) Filed: Oct. 16, 1998

Related U.S. Application Data

(63) Continuation-in-part of application No. 08/953,065, filed on Oct. 20, 1997, now abandoned.

(51) Int. Cl.[7] ..... C22C 45/04

(52) U.S. Cl. ..... 148/403; 148/408; 148/409; 428/678

(58) Field of Search ..... 148/403, 408, 148/409; 428/678, 680

(56) References Cited

U.S. PATENT DOCUMENTS

| | | | |
|---|---|---|---|
| 3,627,654 | A | 12/1971 | Petit et al. |
| 3,892,890 | A | 7/1975 | Watanabe et al. |
| 3,981,781 | A | 9/1976 | Mori et al. |
| 4,074,416 | A | 2/1978 | Rambauske et al. |
| 4,101,389 | A | 7/1978 | Uedaira |
| 4,368,221 | A | 1/1983 | Stefan et al. |
| 4,528,070 | A | 7/1985 | Gamblin |
| 4,554,219 | A | 11/1985 | Gamblin |
| 4,564,565 | A | 1/1986 | Gamblin |
| 4,643,816 | A | 2/1987 | Geels |
| 4,673,468 | A | 6/1987 | Myers et al. |
| 4,767,509 | A | 8/1988 | Gamblin et al. |
| 4,786,390 | A | 11/1988 | Lichtenberger et al. |
| 4,793,953 | A | 12/1988 | Maus |
| 5,032,464 | A | 7/1991 | Lichtenberger |
| 5,074,957 | A | 12/1991 | Horiuti et al. |
| 5,111,335 | A | 5/1992 | Horiuti et al. |
| 5,429,725 | A | 7/1995 | Thorpe et al. |
| 5,435,903 | A | 7/1995 | Oda et al. |
| 5,494,710 | A | 2/1996 | Mallory, Jr. |
| 5,538,674 | A | 7/1996 | Nisper et al. |
| 5,599,632 | A | 2/1997 | Cheng et al. |

FOREIGN PATENT DOCUMENTS

| | | |
|---|---|---|
| JP | 02101192 | 4/1990 |
| WO | WO 90 02220 | 3/1990 |

OTHER PUBLICATIONS

J.W. Dini, R.R. Donaldson, S.K. Syn, and D.J. Sugg, "Diamond Tool Wear of Electrodeposited Nickel–Phosphorous Alloy", presented at the SUR/FIN Conference in Boston, Mass., Jul. 1990.

J.W. Dini, "Electroless Nickel–An Important Coating for Diamong Turing Applications", presented at the Electroless Nickel Conference #2, Mar. 17–18, 1981.

Dini, J.W. et al., "Diamond Tool Wear of Electrodeposited Nickel–Phosphorous Alloy" 1990, pp. 1315–1329.

Becher, U. et al., "Galvanische Abscheidung von Nickel–Phosphor–Legierungen in Mikrostrukturen" 1995, pp. 3180–3186.

(List continued on next page.)

*Primary Examiner*—George Wyszomierski
(74) *Attorney, Agent, or Firm*—Killworth, Gottman, Hagan & Schaeff, L.L.P.

(57) ABSTRACT

The present invention provides amorphous non-laminar nickel phosphorous alloys, amorphous non-laminar nickel cobalt phosphorous alloys, or amorphous non-laminar cobalt phosphorous alloys. These alloys are useful in the formation of metal articles and metal-coated articles, including high precision devices and molds for plastics. In addition, the alloys of the present invention are useful in repairing damaged metal surfaces.

25 Claims, 2 Drawing Sheets-

OTHER PUBLICATIONS

Pouderoux, P. et al., "Plating of nickel–phosphorus multilayer alloys: current pulse effects on the Microstructural and mechanical properties" 1991, pp. 161–170.

Cavallotti, P. et al., "Electroless Ni and Co Baths for Magnetic Recording Disks" 1988, pp. 445–461.

Dubowik, J. et al., "Preparation and Magnetic Properties of Compositionally Modulated NiP/NiCoP Amorphous Films" 1987, pp. 259–261.

Ratzker, M. et al., "Electrodeposition and Corrosion Performance of Nickel–Phosphorous Amorphous Alloys" 1986, pp. 74–82.

Yamamoto, M. et al., "Crystallization and Anomalous Thermal Expansion of Amorphous Ni–P Alloy" Jun. 1, 1991 pp. L1036–L1038.

Riveiro, J.M. et al., "Dendritic growth of electrodeposited Co–P amorphous alloys" Jul. 1993, pp. 18–22.

AMORPHOUS NON-LAMINAR PHOSPHOROUS ALLOYS

This application is a continuation-in-part application of application Ser. No. 08/953,065, filed Oct. 20, 1997, now abandoned.

FIELD OF THE INVENTION

The present invention relates to certain novel amorphous non-laminar phosphorous alloys, and, in particular, relates to amorphous non-laminar nickel phosphorous, amorphous non-laminar cobalt phosphorous and amorphous non-laminar nickel cobalt phosphorous alloys.

BACKGROUND OF THE INVENTION

Articles and devices formed from metal or having metal surfaces or coatings thereon have numerous applications and have found widespread use in a variety of industries. Depending upon the intended end-use of the metal article or metal-coated article, it is desirable that the surface metal exhibit a particular property or combination of properties.

Metal surfaces having properties such as lubricity, wear-resistance and corrosion resistance are desirable for a number of applications, such as molds and molding inserts. However, it is often difficult to achieve this combination of properties in the same metal surface. For example, electroplating an article with hard chrome imparts wear resistance and corrosion resistance to the article. However, an electroplated hard chrome article is time consuming to manufacture, requiring polishing steps prior to and after the electroplating step. In addition to these two polishing steps, when the substrate or article to be coated is hardened steel, the hardened steel must be subjected to a heat treatment step.

Further, the fabrication of high precision devices such as photographic and instrument lenses (Fresnel lenses, lenticular and rotogravure cylinders) as well as molds for optical products and information storage disks, requires that the device or the surface of the device be formed of a material which is very hard (to resist scratching), chemically inert in its ordinary environment (to prevent rusting, oxidation or tarnish which renders the surface unacceptable), and of suitable metallurgical purity (of a highly regular and dense-grain structure-free of slag, impurities, voids, or other unacceptable microflaws).

Initially, these high precision devices were commonly made of a monolithic metal such as aluminum, copper and certain grades of stainless steel and were fabricated in all the usual ways well known to the metal working industry, including metal removal via milling, grinding, lathe turning, fly cutting, or spark erosion by electrical discharge. Once the nominal dimensions, shape or contour of the fabricated device had been attained, the surface of the device was abrasively lapped by successively finer abrasives in a manner well known to those skilled in the art until the contoured surfaces reached satisfactory degrees of smoothness and polish.

More recently, in order to obtain the precision needed, the surface of the device has been machined by a technique known as single-point diamond turning. Single-point diamond turning is accomplished by taking a diamond crystal of the desired size and shape and combining with high precision machines, that may utilize either liquid or gas bearings in controlled environmental conditions, to produce superior quality optical components. This technology is an improvement over the above-mentioned methods that involve grinding, machining and polishing. Those methods are very time consuming, labor intensive and can lead to defects such as deformation and aberrations in the device surface. With diamond turning the tool is so hard and sharp that when very thin layers are cut into certain materials there is minimal edge contact and stress and friction applied to the material are at an absolute minimum. This results in a specular finish and a contour that is an exact replica of the tool path.

A problem with single-point diamond turning is the rapidity with which the diamond turning tool wears out. In addition, although this method of producing precision tooled devices works well, the number of materials with which is it compatible are limited. The materials that have found wide spread existence in the industry today mostly include but are not limited to aluminum, copper, certain grades of stainless steel and electroless nickel/phosphorous alloy.

Although aluminum and copper seem to produce acceptable results, both metals have a microcrystalline grain structure which makes it harder to attain the required surface finish. Both metals are also very soft which makes them susceptible to damage at the slightest contact. Both metals are also very reactive which can lead to severe corrosion even in the mildest of environments.

Stainless steels also have the same crystalline structure problems and because of the is hardness of this material, along with the crystal structure, causes the degradation of the diamond tool very quickly and is difficult and time consuming to polish.

High phosphorous electroless nickel deposits (≧11%) on a base metal substrate gives a surface which seems to have all the desired characteristics for a superior diamond turning material. They are reported as being completely amorphous in structure (no crystalline or grain structure discernible at 150,000×), have reasonable hardness (48-52 Rc) and a natural lubricity or low coefficient of friction that extends diamond tool life. The draw backs of this deposit are with the method, expense and limitations of the deposition process. (The solution chemistry is fairly expensive and at times can be hard to control as the reaction mechanisms are very complex and still to this day are not fully understood.) In addition, high phosphorous electroless nickel deposits typically contain 10–11.5% phosphorous content, with a maximum of 13% being claimed. Nickel/phosphorous alloys having a phosphorous content of between about 11% and about 13% can become slightly magnetic when exposed to temperatures in the range of 250° C. and 300° C. Such temperatures are typically encountered in the manufacture of memory disks. Therefore, memory disks manufactured using nickel/phosphorous alloys having a phosphorous content of between about 11% and about 13% may become slightly magnetic during the manufacturing process and must be rejected. Moreover, because the deposit is laminar in structure, the deposit quality varies greatly with varying layers containing different amounts of phosphorous. This results in a tendency for "banding" or demarcation lines to appear after diamond turning. This can be caused by solution chemistry imbalance (wetting and dispersion agents) and because of the slow deposition rate (0.0002"–0.0005" per hr.). The slow deposition rate also makes it difficult to keep particulate matter out of the solution during the lengthy time required to deposit the nickel/phosphorous alloy to a suitable thickness. Particulate matter can co-deposit with the alloy, thus introducing impurities into the coating and causing a tendency toward the generation of pits and inclusions. The pretreatment cycle for most materials also has to be perfect as the operating solution has a pH that is close to neutral and does not offer any cleaning or oxide removal help the moment before deposition starts. Also because of the above problems and the tendency for the solution to want to plate the related process equipment it is very difficult to obtain high quality deposits over (0.008"–0.010" thick. In addition, it has also been found that electroless nickel deposits may contain discrete cites of crystalline structures which are problematic for diamond turning applications.

For this reason, it has been suggested that an improved mold for optical thermoplastic high-pressure molding can be prepared by electroplating a relatively thick layer of nickel or chromium onto a beryllium-copper alloy substrate of certain specified mechanical and thermal characteristics. Thus, in Maus U.S. Pat. No. 4,793,953, there is disclosed a most preferred mold element construction that consists of, first, a machined beryllium-copper substrate onto which a thick Watts nickel plating was deposited, followed by abrasive lapping to create the specified surface contour to a high level of microstructure perfection and smoothness, onto which a final hardcasting of either vacuum deposited titanium nitride or flash plate of chromium is deposited. But, Watt's nickel plating also has its disadvantages. One being that it cannot be used to deposit a nickel phosphorous of the type deposited by the electroless process.

Of course, it is known that a nickel and/or cobalt phosphorous amorphous alloy can be electrolytically deposited on a base metal surface. In a series of patents now owned by the assignee of the present invention, there is disclosed various baths used for electroplating nickel and/or cobalt phosphorous on a substrate, various anode configurations and shrouds used for that purpose, and various uses for plating procedures. See U.S. Pat. Nos. 4,528,070, 4,643,816, 4,673,468, 4,767,509, 4,786,390, and 5,032,464. Among the uses disclosed are forming ductile alloys (see U.S. Pat. No. 5,032,464) and plating fluid jet orifice plates, electrical contacts, carbon steel or stainless steel cutlery, aluminum articles, cookware substrates (such as aluminum, stainless steel, copper, iron, or cast iron substrates), and materials such as used in the manufacture of computer memory storage discs, and wear surfaces such as thrust bearings, shafts for high speed machinery, or the like (see, for example, U.S. Pat. No. 4,673,468). In addition, the electrodeposited nickel-phosphorous alloy of these patents has been reported to be suitable for diamond turning applications and for forming high precision devices. See J. W. Dini, R. R. Donaldson, S. K. Syn, and D. J. Sugg, "Diamond Tool Wear of Electrodeposited Nickel-Phosphorus Alloy", presented at the SUR/FIN Conference in Boston, Mass. July 1990. However, like the high phosphorous electroless nickel deposits, this electroplated nickel phosphorous alloy is also laminar in structure, and therefore not highly desirable for diamond-turning applications.

As an alternative to the formation of high precision devices by diamond tooling, a high precision device could be made by plating a substrate mandrel which has a precisely-dimensioned surface with a metal or metal alloy suitable for use in high precision devices (i.e., very hard, chemically inert, suitable metallurgical purity), and then separating the metal or metal alloy from the substrate mandrel to give the high precision device. The initial layer of deposit formed would be an exact replica of the precisely-dimensioned substrate mandrel surface and would therefore itself be precisely dimensioned, making it suitable as a high precision device without further fabrication. However, most metals or metal alloys which are suitable for the use in making high precision devices are not well-suited to this electroforming technique in that they exhibit internal stresses which are too great to allow the electroformed metal or alloy to be separated from the substrate mandrel without distortion.

In addition to the problems associated with the fabrication of metal articles or articles having metal surfaces described above, when metal articles or articles with metal surfaces become damaged, they must either be replaced or repaired. Although repair is preferable to replacement to for economic reasons, repairs to damaged metal surfaces are not always straightforward. Traditionally, metal surfaces have been repaired by first machining away the damaged area and then either 1) welding (i.e., filling in the holes with a suitable molten metal or molten metal alloy); 2) forming a new surface by the use of a metallic insert or sleeve; or 3) plating the area with copper, sulfamate nickel or some other metal. The new metal surface formed by any of the three methods is then remachined to finish the repair and/or resurface process. Another traditional repair technique involves plating the damaged area with hard chrome. The hard chrome finish is then subjected to regrinding techniques to finish the repair and/or resurface process. These traditional repair and/or resurfacing techniques, however, have a variety of drawbacks. For example, welding techniques may create heat sinks and distortions around the area repaired. In addition, welding in not compatible with all materials. Repairs made with metallic inserts or sleeves result in a line of demarcation which usually must be welded, thereby creating the potential for heat sinks, distortions and incompatibility of materials. Sulfamate nickel or copper plating result in a surface which is too soft for many applications. Hard chrome plating results in a hard repair surface. However, hard chrome plating cannot be finished by remachining techniques, but must be subjected to time-consuming regrinding techniques.

Accordingly, the need exists for improved metal articles and for articles with improved metal surfaces. Thus, the need exists for improved alloys for making these metal articles and metal surfaces. In addition, the need exists for improved alloys for repairing metal surfaces.

SUMMARY OF THE INVENTION

Those needs are met by the present invention. Thus, the present invention provides amorphous non-laminar nickel phosphorous alloys, amorphous non-laminar nickel cobalt phosphorous alloys, and amorphous non-laminar cobalt phosphorous alloys. Typically, these alloys have a phosphorous content of between about 11% and about 20%.

The present invention further provides articles and/or devices wherein an amorphous non-laminar nickel phosphorous alloy, amorphous non-laminar nickel cobalt phosphorous alloy, and amorphous non-laminar cobalt phosphorous alloy has been deposited thereon. The articles and/or devices of this embodiment are formed by electroplating suitably-dimensioned, load-bearing substrates with an amorphous non-laminar nickel phosphorous alloy, amorphous non-laminar nickel cobalt phosphorous alloy, or amorphous non-laminar cobalt phosphorous alloy of the present invention. Optionally, the articles and/or devices so formed may be finish-machined by conventional techniques and procedures. Alternatively, high precision and/or particularly lustrous articles and/or devices may be formed from the electroplated substrate by subjecting the electroplated substrate to high precision tooling, such as diamond turning.

In addition, the present invention provides articles and/or devices which have been electroformed from an amorphous non-laminar nickel phosphorous alloy, an amorphous non-laminar nickel cobalt phosphorous alloy, or an amorphous non-laminar cobalt phosphorous alloy of the present invention. The articles and/or devices of this embodiment are formed by electroplating suitably-dimensioned, load-bearing substrate mandrels with an amorphous non-laminar nickel phosphorous alloy, amorphous non-laminar nickel cobalt phosphorous alloy, or amorphous non-laminar cobalt phosphorous alloy of the present invention and then separating the amorphous non-laminar nickel phosphorous alloy, amorphous non-laminar nickel cobalt phosphorous alloy, or amorphous non-laminar cobalt phosphorous alloy therefrom to give the electroformed article and/or device. High precision and/or particularly lustrous articles and/or devices may be formed by the above-method by using a mandrel having a precisely-dimensioned surface.

Further provided is a method of preparing the amorphous non-laminar nickel phosphorous alloys, amorphous non-laminar nickel cobalt phosphorous alloys, or amorphous non-laminar cobalt phosphorous alloys by a) providing a bath consisting of nickel ions, cobalt ions, or combinations thereof, and phosphorous ions; b) immersing a suitably dimensioned, load-bearing substrate as a cathode into the bath; c) immersing an anode into the bath; and d) applying an electrical potential across the anode and cathode so as to effect electrodeposition of the alloy onto the substrate while maintaining the cathode efficiency at a range of between about 4 to about 10 mg/amp. min.

Further, there is provided a method of using the amorphous non-laminar nickel phosphorous alloys, amorphous non-laminar nickel cobalt phosphorous alloys, and amorphous non-laminar cobalt phosphorous alloys of the present invention to resurface or repair metal surfaces.

DETAILED DESCRIPTION OF THE INVENTION

Figure 1:
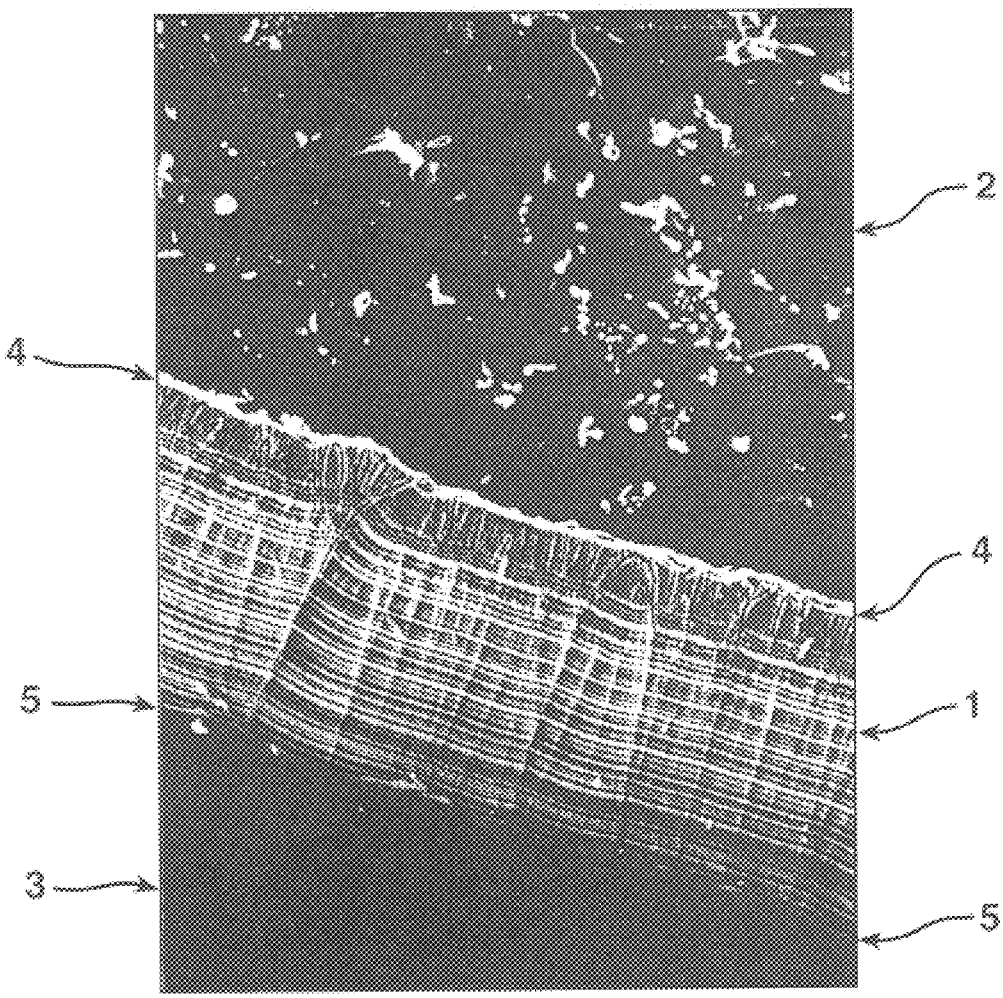
FIG. 1 is a photomicrograph of a cross-section of a laminar electroless nickel-phosphorus alloy of the prior art as taken by a microscope at 593× after a Nital acid etch.

The present invention provides amorphous non-laminar nickel phosphorous alloys, amorphous non-laminar nickel cobalt phosphorous alloys, and amorphous non-laminar cobalt phosphorous alloys. In addition, the present invention provides articles and/or devices wherein an amorphous non-laminar nickel phosphorous alloy, amorphous non-laminar nickel cobalt phosphorous alloy, or amorphous non-laminar cobalt phosphorous alloy has been deposited thereon as well as articles and/or devices which have been electroformed from an amorphous non-laminar nickel phosphorous alloy, amorphous non-laminar nickel cobalt phosphorous alloy, or cobalt phosphorous alloy. Typically, the amorphous non-laminar nickel phosphorous alloys, amorphous non-laminar nickel cobalt phosphorous alloys, and amorphous non-laminar cobalt phosphorous alloys will have a phosphorous content of between about 11% and about 20%.

Articles and/or devices wherein an amorphous non-laminar nickel phosphorous alloy, amorphous non-laminar nickel cobalt phosphorous alloy, or amorphous non-laminar cobalt phosphorous alloy of the present invention has been deposited thereon are formed by electroplating suitably-dimensioned, load-bearing substrates with an amorphous non-laminar nickel phosphorous alloy, amorphous non-laminar nickel cobalt phosphorous alloy, or amorphous non-laminar cobalt phosphorous alloy of the present invention. Optionally, the articles and/or devices so formed may be finish-machined by conventional techniques and procedures. Alternatively, high precision and/or particularly lustrous articles and/or devices may be formed from the electroplated substrate by subjecting the electroplated substrate to high precision tooling, such as diamond turning.

In addition, articles and/or devices which have been electroformed from an amorphous non-laminar nickel phosphorous alloy, an amorphous non-laminar nickel cobalt phosphorous alloy, or an amorphous non-laminar cobalt phosphorous alloy of the present invention are formed by electroplating suitably-dimensioned, load-bearing substrate mandrels with an amorphous non-laminar nickel phosphorous alloy, amorphous non-laminar nickel cobalt phosphorous alloy, or amorphous non-laminar cobalt phosphorous alloy of the present invention and then separating the amorphous non-laminar nickel phosphorous alloy, amorphous non-laminar nickel cobalt phosphorous alloy, or amorphous non-laminar cobalt phosphorous alloy therefrom to give the electroformed article and/or device. High precision and/or particularly lustrous articles and/or devices may be formed by the above-method by using a mandrel having a precisely-dimensioned surface.

In the embodiment of the present invention wherein an amorphous non-laminar nickel phosphorous alloy, amorphous non-laminar nickel cobalt phosphorous alloy, or amorphous non-laminar cobalt phosphorous alloy of the present invention is deposited on a suitably-dimensioned substrate, suitable substrate components may be composed of any material which has sufficient load bearing capabilities to retain its dimensions when plated with the alloy and which may be fashioned into dimensions suitable for forming the article and/or device. As used herein, the term "suitably-dimensioned" means fabricated to the nominal dimensions, shape or contour of the desired high-precision device to be formed. Examples of suitable substrates are substrates composed of metals, such as aluminum, stainless steel, copper, beryllium, molybdenum, nickel, steel, and the like, substrates composed of metal alloys, such as beryllium -copper, various brass or bronze alloys, and the like, as well as composite such as carbon composites, graphite composites and carbon/epoxy composites, plastic, glass, ceramics, ceramic alloys, and the like. In cases where the substrate component is composed of metal or a metal alloy, the substrate component may be suitably-dimensioned by the usual ways well known in the metal working industry, including metal removal via milling, grinding, lathe turning, fly cutting or spark erosion by electrical discharge. In cases where the substrate component is composed of a composite, the substrate component may be suitably-dimensioned by, for example, molding techniques. Typically, the substrate component is fabricated to suitable dimensions anywhere from about 0.001" to about 0.100" or more undersize depending on the design, application and surface finish requirements of the article and/or device to be formed.

In the embodiment of the present invention which involves electroplating a suitably-dimensioned substrate mandrel with an amorphous non-laminar nickel phosphorous alloy, amorphous non-laminar nickel cobalt phosphorous alloy, or amorphous non-laminar cobalt phosphorous alloy of the present invention, suitable substrate mandrels are composed of any material which has sufficient load bearing capabilities to retain its dimensions when plated with the alloy and whose surface is suitable for the end-application of the article and/or device. For example, when the article and/or device is to be a high precision device, the surface of the suitably-dimensioned mandrel is must be precisely-dimensioned or have a surface which may be fashioned to precise dimensions. As used herein, the term "precisely dimensioned" means suitable as a high precision device or suitable for forming a high precision device without the need for further fabrication. Examples of suitable substrate mandrels are substrate mandrels composed of materials which include glass, stainless steel, wax, aluminum, nickel, copper and the like. Prior to plating, the suitable substrate mandrel for use in the embodiment which involves electroplating a substrate mandrel is first suitably-dimensioned, is fabricated to form the nominal dimensions, shape or contour of the article and/or device to be formed by methods well known to those skilled. If the article and/or device is to be a high precision device, the surface of the suitably-dimensioned substrate mandrel may is then fashioned into a precisely-dimensioned surface by procedures and techniques well-known in the art, for example, by high precision tooling techniques. Examples of substrate mandrels are substrate mandrels composed of metals, such as stainless steel, nickel, copper and the like. Alternatively, the substrate mandrel may be initially formed in such a way that the substrate mandrel has a precisely-dimensioned surface without the need for further fabrication. Examples of substrate mandrels which are formed in such a way that they have a precisely-dimensioned surface without the need for further fabrication are substrate mandrels which themselves have been formed from a mold or mandrel having a precisely-dimensioned surface. Such substrate mandrels could be formed by molding techniques well known in the art or by plating and separating techniques as taught herein. Alternatively, the substrate mandrel may be formed from a material which inherently results in a precisely-dimensioned surface without the need for further fabrication. Examples of substrate mandrels which are composed of materials such that they have a precisely-dimensioned surface without the need for further fabrication are glass, wax, epoxy composites, graphite composites, epoxy-graphite composites, ceramics, plastics and the like.

The suitably dimensioned substrate component or suitably-dimensioned substrate mandrel is then plated with an amorphous non-laminar nickel phosphorous alloy, amorphous non-laminar cobalt phosphorous alloy, or amorphous non-laminar nickel cobalt phosphorous alloy of the present invention by means of electrodeposition. Portions of the suitably-dimensioned substrate component or suitably-dimensioned load-bearing substrate mandrel where plating is not desired are masked off by the use of plater's tape or special paints, as is well known in the electroplating industry.

In the embodiment of the present invention wherein an amorphous non-laminar nickel phosphorous alloy, amorphous non-laminar nickel cobalt phosphorous alloy, or amorphous non-laminar cobalt phosphorous alloy of the present invention which has been deposited on a suitably-dimensioned substrate is subjected to conventional finishing techniques and procedures, the alloy may be deposited to any thickness which is suitable for the design, application and surface finish requirements of the high precision device to be formed and will typically be a thickness of approximately 0.0005 inches to approximately 0.1 inches. In the embodiment of the present invention wherein am amorphous non-laminar nickel phosphorous alloy, amorphous non-laminar nickel cobalt phosphorous alloy, or amorphous non-laminar cobalt phosphorous alloy of the present invention which has been deposited on a suitably-dimensioned substrate is subjected to high precision tooling, the alloy may be deposited to any thickness which is suitable for the design, application and surface finish requirements of the high precision device to be formed and will typically be a thickness of approximately 0.005 inches to approximately 0.030 inches.

In the embodiment of the present invention which involves electroplating a suitably-dimensioned substrate mandrel with an amorphous non-laminar nickel phosphorous alloy, amorphous non-laminar nickel cobalt phosphorous alloy, or amorphous non-laminar cobalt phosphorous alloy of the present invention, the alloy is deposited to a thickness which is not only suitable for the requirements of the article and/or device to be formed, but which is also thick enough to give sufficient support and rigidity to the article and/or device and will typically be in the range of approximately 0.001 inches to approximately 0.5 inches. In the embodiment of the present invention which involves electroplating a suitably-dimensioned substrate mandrel having a precisely-dimensioned surface with an amorphous non-laminar nickel phosphorous alloy, amorphous non-laminar nickel cobalt phosphorous alloy, or amorphous non-laminar cobalt phosphorous alloy of the present invention, the alloy is deposited to a thickness which is not only suitable for the requirements of the high precision device to be formed, but which is also thick enough to give sufficient support and rigidity to the high precision device and will typically be in the range of approximately 0.001 inches to approximately 0.5 inches Prior to electroplating, the suitably-dimensioned substrate component or suitably-dimensioned substrate mandrel is appropriately fixtured to insure a good electrical connection to the cathode or negative pole of a rectifier. The substrate component or substrate mandrel is then prepared for electroplating by conventional pretreatment procedures and techniques well known in the art. For example, when the substrate component or substrate mandrel is composed of stainless steel, the substrate component or substrate mandrel may be bead blasted with a fine grit glass bead, immersed in a hot alkaline soak cleaner for about 10–15 minutes, thoroughly rinsed in deionized water, immersed in about 50% vol. hydrochloric acid for approximately 3–5 min, thoroughly rinsed in deionized water, immersed in a sulfuric acid etch solution and made anodic at about 200–300 A.S.F. for approximately 30–45 sec., thoroughly rinsed in deionized water, the hot alkaline electrocleaner step repeated, thoroughly rinsed in deionized water, immersed in 50% hydrochloric acid for approximately 30–90 sec., thoroughly rinsed in deionized water, immersed in Wood's nickel strike (32 oz/gal NiCl and 16 fl. oz/gal HCl, ambient temp.) and made cathodic at a current density of about 50 to about 75 A.S.F for approximately 3–5 minutes and then thoroughly rinsed in deionized water. When the substrate component or substrate mandrel is composed of glass, for example, conventional pretreatment methods used in the "plating on plastics" industry may be utilized. For example, the glass surface may be seeded with palladium and a thin film of electroless nickel deposited on the surface to serve as an electroplate base. Alternatively, the glass surface could be sprayed with a conductive paint.

An amorphous non-laminar nickel phosphorous alloy is plated onto the substrate component or substrate mandrel by immersing the pretreated substrate component or substrate mandrel in a nickel/phosphorous electroplating solution at a cathode current density of approximately 50 A.S.F. for a period of time sufficient to deposit the required thickness of alloy coating. The electrolytic solution is initially operated with inert anodes under standard parameters. At a cathode current density of approximately 50 A.S.F., a typical average deposition rate will be approximately 0.001" per hour.

The nickel/phosphorous electroplating solution is composed of about 0.5 to about 1.4M nickel as metal, about 0.5 to about 4.0M phosphorous acid, and about 1.0 to about 3.0M chloride ion. The chloride salts also serve to supply chloride ions which aid in the prevention of metal oxide films on the anode. The electrolytic solution may also contain additional components to aid in the electroplating process. Examples of such additional components are buffers, wetting agents, surfactants, and the like. During the operation of the bath, anywhere from about 0 to about 4.0M phosphoric acid may be generated as a by-product that forms from the oxidation of the phosphorous acid at the anode. The rate of buildup of phosphoric acid is dependent upon the type of anode arrangement used and the anode current density during operation. Small amounts of phosphoric acid (approximately 0.3–1.0M) result in increased brightness and leveling capabilities of the deposit. Amounts of phosphoric acid over 1.0M do not have a deleterious effect on the electrodeposition and the concentration of phosphoric acid soon reaches an equilibrium condition where either buildup equals removal from dragout or a saturation condition is reached. The phosphorous ions are supplied by the phosphorous acid. The nickel metal is initially supplied with nickel salts, such as nickel chloride or nickel carbonate and are monitored frequently during the electroplating process with standard EDTA titration. When the nickel concentration reaches approximately 0.9M, additional nickel ions may be supplied by either the addition of nickel salts or by the use of a nickel anode in conjunction with an anode of inert material. Suitable inert anodes are anodes composed of platinum or rhodium as is described in U.S. Pat. No. 4,786,390, which is hereby incorporated by reference, or composed of any conductive nonmetal materials capable of withstanding the solution environment and operating conditions, such as ceramic, graphite, and the like. Where the nickel ions are maintained by the use of a nickel anode in conjunction with an anode of inert material, the nickel and inert anode may either be continuously alternated in the electroplating solution, or both nickel and inert anodes may be used at the same time with the use of rheostats to control the proper amount of current to each anode material to maintain the desired nickel ion concentration. Typically, when nickel and inert anodes are used at the same time, approximately 80% of the current is directed to the nickel anode and approximately 20% is directed to the inert anode. The nickel anodes and inert anodes are suspended in the electrolytic solution on separate conductors (buss bar). Each conductor is then connected to the positive pole of a DC rectifier with a separate rheostat connected between the positive pole and each separate conductor. The total output current for the positive pole of the rectifier is then varied between the different anodes to achieve an equilibrium condition in which the nickel metal in the electrolytic solution is maintained at a constant value. When nickel and inert anodes are used alternatively, when the nickel ions reach approximately 0.9M, the inert anode initially used is removed and nickel anodes in the form of nickel rounds or squares in titanium baskets are then placed in the bath. When the nickel concentration reaches approximately 1.1M, the nickel anodes are replaced with inert anodes. This cycle is then continually repeated. The frequency at which the anodes are alternated depends on the amount of surface area of the substrate component or substrate mandrel and coating thickness deposited per gallon of plating solution.

Typical operating temperatures are between about about 125° F. to about 180° F., with about 150° F. to about 170° F. being preferred and about 158° F. to about 165° F. being particularly preferred. The surface tension of the bath is monitored with the use of a tensionmeter and may optionally be controlled with the addition of a sulfate free surfactant.

The cathode efficiency is believed to be the single most important factor for controlling the deposit quality and characteristics such as phosphorous content, ductility, deposit stress, appearance and deposition rate. For example, the amorphous non-laminar nickel phosphorous alloys of the present invention may be produced by maintaining the cathode efficiency between about 4 to about 10 mg/amp min. In addition, an amorphous non-laminar nickel phosphorous alloy of the present invention with a phosphorous content of between about 11% and about 13% may be produced by maintaining the cathode efficiency between about 6 to about 9 mg/amp. min. while an amorphous non-laminar nickel phosphorous alloy of the present invention with a phosphorous content between about 13% and about 15% may be produced by maintaining the cathode efficiency between about 4 to about 6 mg/amp.min. Cathode efficiency can be controlled by altering the chloride content or temperature of the solution. The cathode efficiency is increased by raising either the chloride content or raising the operating temperature. Alternatively, it can be lowered by decreasing the chloride content or operating temperature.

In addition, amorphous non-laminar nickel phosphorous alloys of the present invention with a phosphorous content between about 16% and about 20% may be prepared by utilizing the plating conditions described above for preparing an amorphous non-laminar nickel phosphorous alloy of the present invention with a phosphorous content between about 13% and about 15%, but modifying the direct current wave form out of the rectifier by techniques and procedures well known to one of ordinary skill in the art. For example, the direct current wave form is modified out of the rectifier may be accomplished by pulse plating or periodic reverse plating. In pulse plating, the DC current is interrupted periodically (turned on and off). The on and off times are typically in the millisecond to second range and the on/off times can be adjusted separately. This allows the cathode diffusion (boundary) layer to be more thoroughly replenished with ions from the bulk of the solution during the off cycle, reduces polarization tendencies, and helps to keep the concentration of $H_3PO_3$ at the cathode diffusion layer at the optimum concentration, thereby increasing the amount of phosphorous in the deposit. Periodic reverse plating involves altering the direct current wave form out of the rectifier by alternatively changing the polarity of the electrodes from positive to negative at adjustable time intervals, typically in the millisecond to second range. The substrate or substrate mandrel is typically made the cathode or negative electrode for a longer time or it is subjected to a higher current density than it normally would be if it were made the anode or positive electrode. By preferentially removing nickel from the deposit while the part is on the reverse (positive or anodic) part of the cycle, the phosphorous content of the deposit is increased.

Using the above techniques of adjusting the cathode efficiency and modifying the direct current wave form out of the rectifier, amorphous non-laminar nickel phosphorous alloys of the present invention may be produced which have a phosphorous content of between about 11% and about 20%. Other typical phosphorous contents of the alloys of the present invention are the following: 1) about 11% to about 12%; 2) about 11% to about 13%; 3) about 11% to about 14%; 4) about 11% to about 15%; 5) about 11% to about 16%; 6) about 11% to about 17%; 7) about 11% to about 18%; 8) about 11% to about 19%; 9) about 12% to about 13%; 10) about 12% to about 14%; 11) about 12% to about 15%; 12) about 12% to about 16%; 13) about 12% to about 17%; 14) about 12% to about 18%; 15) about 12% to about 19%; 16) about 12% to about 20%; 17) about 13% to about 14%; 18) about 13% to about 15%; 19) about 13% to about 16%; 20) about 13% to about 17%; 21) about 13% to about 18%; 22) about 13% to about 19%; 23) about 13% to about 20%; 24) about 14% to about 15%; 25) about 14% to about 16%; 26) about 14% to about 17%; 27) about 14% to about 18%; 28) about 14% to about 19%; 29) about 14% to about 20%; 30) about 15% to about 16%; 31) about 15% to about 17%; 32) about 15% to about 18%; 33) about 15% to about 19%; 34) about 15% to about 20%; 35) about 16% to about 17%; 36) about 16% to about 18%; 37) about 16% to about 19%; 38) about 16% to about 20%; 39) about 17% to about 18%; 40) about 17% to about 19%; 41) about 17% to about 20%; 42) about 18% to about 19%; 43) about 18% to about 20%; and 44) about 19% to about 20%.

As stated previously, nickel/phosphorous alloys having a phosphorous content of between about 11% and about 13% can become slightly magnetic when exposed to temperatures in the range of 250° C. and 300° C. Such temperatures are typically encountered in the manufacture of memory disks. Therefore, memory disks manufactured using nickel/phosphorous alloys having a phosphorous content of between about 11% and about 13% may become slightly magnetic during the manufacturing process and must be rejected. However, memory disks manufactured using nickel/phosphorous alloys having a phosphorous content of about 13% or higher do not have the same tendency to become magnetic when exposed to temperatures in the range of 250° C. and 300° C. Therefore, the amorphous non-laminar nickel/phosphorous alloys of the present invention having a phosphorous content of about 13% or higher are particularly suited to the manufacture of memory disks. Thus, the amorphous non-laminar nickel/phosphorous alloys of the present invention having a phosphorous content of about 13% to about 15% are particularly well-suited to the manufacture of memory disks, while the amorphous non-laminar nickel/phosphorous alloys of the present invention having a phosphorous content of about 16% to about 20% are especially well-suited to the manufacture of memory disks.

When an amorphous non-laminar cobalt phosphorous alloy of the present invention is to be plated onto the substrate component or substrate mandrel, the procedure is identical to that described above for amorphous non-laminar nickel phosphorous alloy, but substituting cobalt ions for nickel ions and cobalt anodes for nickel anodes. Cobalt ions are typically supplied with cobalt salts, such as cobalt carbonate or cobalt chloride. The phosphorous content of the amorphous non-laminar cobalt phosphorous alloys may be adjusted as described previously for the amorphous non-laminar nickel phosphorous alloys and results in the preparation of amorphous non-laminar cobalt phosphorous alloys typically having a phosphorous content of between about 11% and about 20%.

When an amorphous non-laminar nickel cobalt phosphorous alloy of the present invention is to be plated onto the substrate component or substrate mandrel, the procedure is also identical to that described above for amorphous non-laminar nickel phosphorous alloy, but approximately 25% of the nickel content is substituted by cobalt, such as cobalt salts as indicated above. The phosphorous content of the amorphous non-laminar nickel cobalt phosphorous alloys may be adjusted as described previously for the amorphous non-laminar nickel phosphorous alloys and results in the preparation of amorphous non-laminar nickel cobalt phosphorous alloys typically having a phosphorous content of between about 11% and about 20%.

In the embodiment of the present invention wherein an amorphous non-laminar nickel phosphorous alloy, amorphous non-laminar nickel cobalt phosphorous alloy, or amorphous non-laminar cobalt phosphorous alloy of the present invention has been deposited on a suitably-dimensioned substrate is subjected to either conventional finishing techniques and procedures or to high precision tooling, after the amorphous non-laminar nickel phosphorous alloy, amorphous non-laminar cobalt phosphorous alloy, or amorphous non-laminar nickel cobalt phosphorous alloy is plated onto the substrate component, the substrate component is unmasked and the alloy coated substrate component is "rough machined" to dimensions which are "close" to the final dimensions desired on the article and/or device. Techniques for such "rough machining" are well known to those in the art, and include CNC machining. The alloy coated substrate component is then subjected to either conventional techniques, such as grinding, lapping and other conventional machining techniques and procedures or to high precision tooling. As used herein, the term "high precision tooling" refers to any technique suitable for fabricating a highly precise surface and includes techniques such as hard tool turning, such as diamond turning or machining with various ceramic cutting tools or ceramic alloy cutting tools. The choice of technique depends upon the final quality, accuracy and surface finish requirements of the final high precision device to be formed. Therefore, in contrast to conventional hard chrome plating which requires a polishing and/or grinding step both before and after electroplating, electroplating a substrate with the alloys of the present invention does not require either a pre-plating or post-plating polishing step, but merely requires a post-plating machine-finishing step.

In the embodiment of the present invention which involves electroplating a suitably-dimensioned substrate mandrel with an amorphous non-laminar nickel phosphorous alloy, amorphous non-laminar nickel cobalt phosphorous alloy, or amorphous non-laminar cobalt phosphorous alloy of the present invention, after the amorphous non-laminar nickel phosphorous alloy, amorphous non-laminar cobalt phosphorous alloy, or amorphous non-laminar nickel cobalt phosphorous alloy is plated onto the substrate mandrel, the amorphous non-laminar nickel/phosphorous alloy, amorphous non-laminar nickel/cobalt/phosphorous alloy, or amorphous non-laminar cobalt/phosphorous alloy is separated from the substrate mandrel to give the article and/or device. The initial layer of deposit formed is an exact replica of the substrate mandrel surface and is therefore, if the surface of the substrate mandrel is precisely-dimensioned, the article and/or device so formed is precisely dimensioned. The amorphous non-laminar nickel/phosphorous alloys, amorphous non-laminar cobalt/phosphorous alloys, and amorphous non-laminar nickel/cobalt/phosphorous alloys of the present invention exhibit an internal stress which is very low, being approximately 2000 lbs tensile to about 3000 lbs compressive. This very low internal stress allows the alloys of the present invention to be released from the substrate mandrel without distortion.

As stated previously, the alloys of the present invention are particularly useful for making metal articles and articles with metal-coated surfaces whose end-application requires lubricity, hardness and wear-resistance, and corrosion-resistance, such as molds and molding inserts. For example, molds formed from the alloys of the present invention or coated with the alloys of the present invention are particularly well-suited for molding plastics and may be used to fabricate high pressure injection molds, compression molds, thermoset molds, replication molds, electroforming molds, and the like. The natural lubricity of the alloys of the present invention results in the plastic being more easily removed from the mold or molding insert. This in turn results in reduced cycle times and an overall increase in the production of the molded plastic product.

Figure 2:
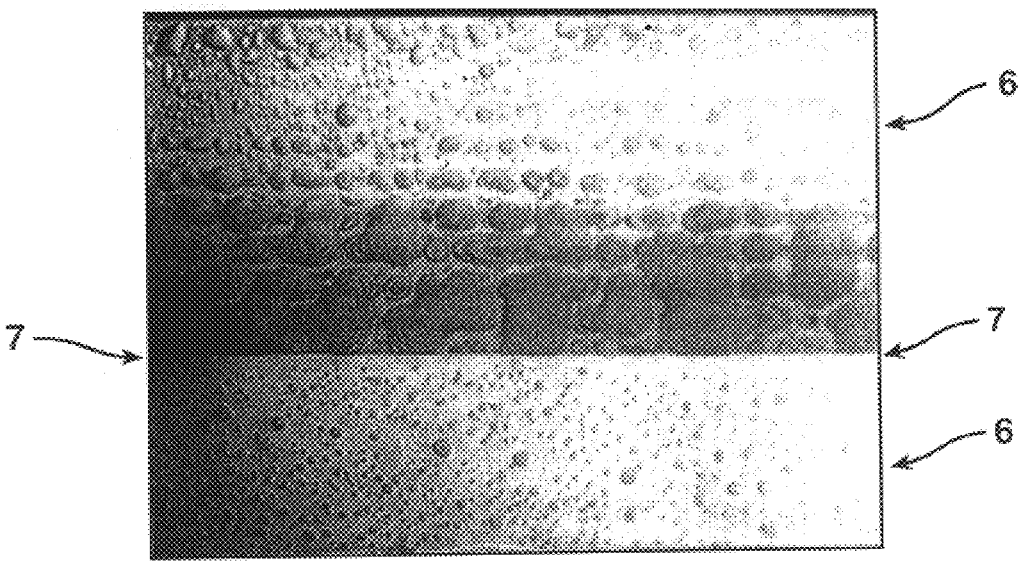
FIG. 2 is a photomicrograph of a cross-section of a laminar electroplated laminar nickel-phosphorous alloy of the prior art as taken by a microscope at 500× after a 5% Nital etch.
Figure 3:
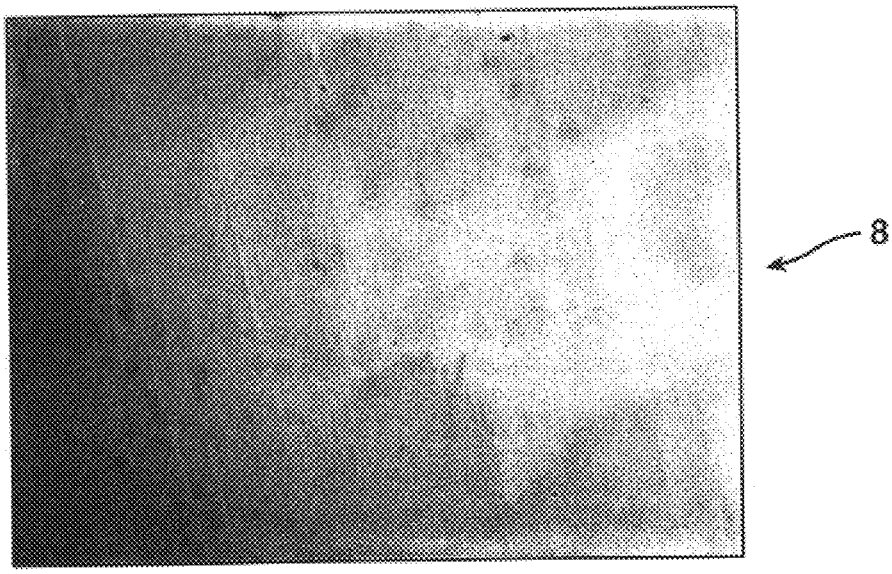
FIG. 3 is a photomicrograph of an a cross-section of an amorphous non-laminar nickel phosphorous alloy of the present invention as taken by a microscope at 500× after a 5% Nital etch.

In addition, the alloys of the present invention are non-laminar in structure whereas the nickel phosphorous, nickel cobalt phosphorous, and cobalt phosphorous alloys formed by either electroless methods or by the method described in U.S. Pat. Nos. 4,528,070, 4,643,816, 4,673,468, 4,767,509, 4,786,390 and 5,032,464 are laminar in structure. FIG. 1 is a photomicrograph of a cross-section of an electroless nickel phosphorous alloy as taken by a microscope 593× after a Nital acid etch, wherein the electroless nickel/phosphorous alloy 1 is plated on steel coupon 2 and mounted on epoxy 3 and defined by demarcation lines 4 and 5. The laminar structure of the electroless nickel/phosphorous alloy 1 is evident from the plurality of thick whitish-lines which run parallel to each other and to demarcation lines 4 and 5. FIG. 2 is a photomicrograph of a cross-section of a laminar electroplated nickel-phosphorous alloy of the prior art as taken by a microscope at 500× after a 5% Nital etch, wherein the electroplated nickel/phosphorous alloy 6 comprises essentially the entire photomicrograph. Electroplated nickel/phosphorous alloy 6 has a demarcation line 7 within the alloy which is believed to have resulted from a stopping and restarting of the electroplating operation. The laminar structure of the electroplated nickel/phosphorous alloy 6 is evident from the plurality of thick parallel lines of darkened "bubble-like" regions. FIG. 3 is a photomicrograph of a cross-section of the amorphous non-laminar nickel phosphorous alloy of the present invention as taken by a microscope at 500× after a 5% Nital etch wherein the Ni/P alloy 8 comprises the entire photomicrograph. Nickel/phosphorous alloy 8 has a plurality of faint, diagonally running, randomly spaced grooves which are polishing lines. The amorphous non-laminar structure of the nickel/phosphorous alloy 8 is evident from the absence of a plurality of thick, parallel lines or regions.

The amorphous non-laminar structure of the alloys of the present invention renders then particularly suitable for the fabrication of high precision devices formed by hard-tool turning applications. Because the alloys are amorphous non-laminar, the quality of the alloy deposit is consistent throughout the deposit. Hence, there is no tendency for the formation of "banding" or demarcation lines after hard-tool turning. In addition, the high phosphorous content of the alloys of the present invention also makes them particularly well-suited to hard-tool turning applications, with the alloys of the present invention having a phosphorous content of between about 13% and about 15% being particularly preferred, and those having a phosphorous content of between about 16% and about 20% being especially preferred. Further, the alloys of the present invention, being amorphous in structure (i.e., no crystalline or grain structure discernible at 150,000×), are particularly well-suited to hard-tool turning in that the required surface finish is more easily obtained than with a non-amorphous metal or metal alloy, such as aluminum, copper, and stainless steels.

In addition, the amorphous non-laminar nickel/phosphorous alloys, amorphous non-laminar nickel/cobalt/phosphorous alloys, or amorphous non-laminar cobalt/phosphorous alloys of the present invention exhibit very low internal stress. This very low internal stress makes them particularly well suited to forming articles and/or devices, including high precision devices by the technique of electroplating a suitably-dimensioned load-bearing substrate mandrel and then separating the alloy from the substrate mandrel to form the article and/or device. The amorphous non-laminar nickel/phosphorous alloys, cobalt/phosphorous alloys, or nickel/cobalt/phosphorous alloys of the present invention, because they have a very low internal stress, may be separated from the substrate mandrel without distortion.

Further, the amorphous non-laminar nickel phosphorous alloys, amorphous non-laminar nickel cobalt phosphorous alloys, and amorphous non-laminar cobalt phosphorous alloys of the present invention are useful in resurfacing or repairing metal surfaces. After any necessary surface-treatment steps (e.g., machining away the damaged areas on the metal surface to be repaired), at least a portion of the damaged surface is electroplated with an amorphous non-laminar nickel phosphorous alloy, amorphous non-laminar nickel cobalt phosphorous alloy, or amorphous non-laminar cobalt phosphorous alloy of the present invention using techniques and procedures described previously. If necessary, the electoplated alloy may then be machined or subjected to high precision tooling as described previously. The amorphous non-laminar nickel phosphorous alloys, amorphous non-laminar nickel cobalt phosphorous alloys, and amorphous non-laminar cobalt phosphorous alloys of the present invention may be used to repair any metal or metal alloy surface.

Repairs to damaged metal surfaces made with the amorphous non-laminar nickel phosphorous alloys, amorphous non-laminar nickel cobalt phosphorous alloys, and amorphous non-laminar cobalt phosphorous alloys of the present invention are superior to traditional metal-surface repairing techniques. Because the alloys of the present invention are more dense, more pure, and more defect-free than traditional repairing materials (e.g., inserts, welds, and plating), the repair is virtually defect-free, exhibiting few pits and/or inclusions. In addition, because the alloys of the present invention are particularly well-suited to hard tool turning, the repaired article may be hard tool turned to a superior mirror finish without the need for polishing steps before and after the plating steps. In addition, unlike repairs made with hard chrome, repairs made with the alloys of the present invention may be finished by remachining techniques rather than time-consuming regrinding techniques.

Further, the amorphous non-laminar nickel/phosphorous alloys, amorphous non-laminar nickel/cobalt/phosphorous alloys, or amorphous non-laminar cobalt/phosphorous alloys of the present invention may be deposited at a speed of about 0.001" per hour, making them particularly well-suited for commercial use. In addition, because the time required to deposit the alloys to the required thickness is shortened, particulate matter is easily kept out of the electroplating solution and the resulting alloys exhibit increased purity over alloys formed by slow deposition speeds.

In addition, the electroplating baths used to form the amorphous non-laminar nickel/phosphorous alloys, amorphous non-laminar nickel/cobalt/phosphorous alloys, and amorphous non-laminar cobalt/phosphorous alloys of the present invention are viable over an extended period of time by simply replenishing reagents as required.

Finally, although particularly well-suited for the fabrication of article and/or devices, including molds, molding inserts, and high precision devices, and for the repairing of metal surfaces, the alloys of the present invention are also suitable for such conventional purposes as decorative and protective purposes and for any purpose wherein a property and/or combination of properties exhibited by the alloys of the present invention is required or desired.

The following examples present typical applications as described above. These examples are understood to be illustrative only and are not intended to limit the scope of the present invention in any way.

EXAMPLE 1

A 3" diameter aluminum disc was immersed in the an electrolytic bath consisting of 0.5–1.5M nickel as metal; 1.5–4.0M phosphorous acid, 0.2–4.0M phosphoric acid and 1.5–3.0M chloride and electrolytically connected to a DC power supply as the cathode. It was plated at a current density of 50 amps/ft$^2$ for 10 hours. The test part had a coating thickness of approximately 0.011". Diamond turning gave an excellent finish when measured with a Zygo and Wyko surface and height measuring interferometers. In addition, a witness coupon plated under the same conditions had a phosphorous content of 13%.

EXAMPLE 2

A cylinder with dimensions of 19" long by 6" diameter was prepared with a standard pretreament cycle, flashed with approximately 0.0005" of a standard electroless nickel deposit, then immersed as the cathode in the solution described in Example 1 at a current density of 50 amps/ft2 for approximately 20 hrs. The cylinder was coated with 0.020" of the electrolytic nickel/phosphorous deposit. The nickel/phosphorous electroplating solution was composed of about 0.8 to about 1.2M nickel as metal and about 2.8 to about 3.2M phosphorous acid, and about 1.8 to about 2–2M chloride ion. This deposit was then diamond turned with a certain groove geometry spanning approximately 600 miles with excellent quality and minimal degradation of the diamond tool. For comparison, this was also attempted using a conventional electroless nickel deposit and the diamond tool and/or coating quality was unacceptable after approximately 60 miles.

EXAMPLE 3

A stainless steel substrate that was approximately 0.375" dia.×1.5" long was coated with 0.050" to 0.060" of the electrolytic nickel/phosphorous deposit on the face of the 0.375" dia. The nickel/phosphorous electroplating solution was composed of about 1.0M nickel as metal and about 3.0M phosphorous acid, and about 2.0M chloride ion. A Fresnel lens with a groove depth of 0.035" was cut into the deposit. The quality of the final product was excellent and this was also unattainable with conventional electroless technology.

EXAMPLE 4

An article made of a carbon/epoxy composite needed to have a highly reflective finish on one critical surface. The composite material was chosen for its rigidity and light weight. The non-critical surfaces were masked. Then a conductive metal containing paint was sprayed on the primary surface and allowed to cure. This rendered the surface conductive and allowed for a standard pretreatment cycle and subsequent electroplating in the solution described in Example 1. A high quality amorphous 13% nickel/phosphorous coating (by witness coupon) was obtained and subsequently diamond turned.

EXAMPLE 5

An approximately 3" diameter copper insert was coated with 0.030" of a nickel/phosphorous alloy deposited from the solution described in Example 1. The surface was then diamond turned with the structure needed and used as a mold for bi-focal eye glass lens.

EXAMPLE 6

A 3" diameter piece of optical glass was masked on one side. The opposite side was metallized using conventional pretreatment methods used in the "plating on plastics" industry involving seeding the glass layer with palladium and then depositing a thin film of electroless nickel as an electroplate base. That surface was then built up with a very heavy layer of the electrolytic nickel/phosphorous deposit (0.150"). The deposit itself was then separated from the glass mandrel. The initial layer of the deposit formed is an exact replica of the optical glass and that surface then becomes the surface for molding and the remaining deposit is used for support and rigidity.

EXAMPLE 7

Two 18" diameter by 60" long mold steel rolls were coated with 0.20" of an electrolytic nickel phosphorous alloy essentially as described in Example 1 using an electrolytic bath consisting of 1.0M nickel as metal; 1.8 M chloride; 2.5 M phosphorous acid; and 1.25 M phosphoric acid having a surface tension of <30 dynes/cm at a solution temperature of 160° F., cathode efficiency of 5.4 mg/amp. min., current density of 25 am/s/square ft, and a deposit stress of 1500 lbs compressive. The deposit was ground to clean and then diamond turned with a groove geometry. The roll in this condition is often referred to as a lenticular lens cylinder and is used in a plastic extrusion process to manufacture plastic films with various groove geometry's. These films are then used to alter or enhance images in the area of holographics, computer screens, and large projection screens.

After the cylinder was diamond turned, the shavings were returned and analyzed for phosphorous content using ISO-4527 standard test method and found to be >14.5% (shavings from one roll having a phosphorous content of 14.6% and the other having a phosphorous content of 14.7%).

What is claimed is:

1. An amorphous non-laminar Ni/P alloy produced by electrodeposition of the alloy while maintaining the cathode efficiency at a range of between about 4 and 10 mg/amp. min. and characterized by the absence of a plurality of thick, parallel lines or regions in cross-sectional photomicrographs of the alloy after electrodeposition.

2. An amorphous non-laminar Ni/P alloy according to claim 1 having a phosphorous content of between about 11% and about 20%.

3. An amorphous non-laminar Ni/P alloy according to claim 2 having a phosphorous content of between about 11% and about 13%.

4. An amorphous non-laminar Ni/P alloy according to claim 2 having a phosphorous content of between about 13% and about 15%.

5. An amorphous non-laminar Ni/P alloy according to claim 2 having a phosphorous content of between about 15% and about 20%.

6. An amorphous non-laminar Ni/Co/P alloy produced by electrodeposition of the alloy while maintaining the cathode efficiency at a range of between about 4 and 10 mg/amp. min. and characterized by the absence of a plurality of thick, parallel lines or regions in cross-sectional photomicrographs of the alloy after electrodeposition.

7. An amorphous non-laminar Co/P alloy produced by electrodeposition of the alloy while maintaining the cathode efficiency at a range of between about 4 and 10 mg/amp. min. and characterized by the absence of a plurality of thick, parallel lines or regions in cross-sectional photomicrographs of the alloy after electrodeposition.

8. An article or device comprised of a substrate having an amorphous non-laminar Ni/P alloy, amorphous non-laminar Ni/Co/P alloy, or amorphous non-laminar Co/P alloy deposited thereon produced by electrodeposition of the alloy on said substrate while maintaining the cathode efficiency at a range of between about 4 and about 10 mg/amp. min. and wherein the amorphous non-laminar alloy is characterized by the absence of a plurality of thick, parallel lines or regions in cross-sectional photomicrographs of the alloy after electrodeposition.

9. An article or device according to claim 8 wherein the substrate has an amorphous non-laminar Ni/P alloy deposited thereon.

10. A article or device according to claim 9, wherein the amorphous non-laminar Ni/P alloy has a phosphorous content of between about 11% and about 20%.

11. An article or device according to claim 10 wherein the amorphous non-laminar Ni/P alloy has a phosphorous content is between about 11% and about 13%.

12. An article or device according to claim 10 wherein the amorphous non-laminar Ni/P alloy has a phosphorous content is between about 13% and about 15%.

13. An article or device according to claim 10 wherein the amorphous non-laminar Ni/P alloy has a phosphorous content is between about 15% and about 20%.

14. An article or device according to claim 9 which is a mold or molding insert.

15. An article or device according to claim 14 wherein the mold or molding insert is a mold or molding insert for plastic.

16. An article or device according to claim 14 wherein the mold or molding insert is a high pressure injection mold, compression mold, thermoset mold, replication mold, or electroforming mold.

17. An article or device according to claim 9 wherein the article or device is selected from information storage disks, Fresnel lenses, photographic lenses, instrument lenses, lenticular lenses, rotogravure cylinders, or reflective surfaces for telescopic laser or infrared sensor applications.

18. An article or device according to claim 17 wherein the article or device is an information storage disk.

19. An article or device according to claim 18 wherein the information storage disk is a computer memory disk.

20. An article or device according to claim 9 wherein the substrate is a substrate mandrel.

21. An article or device according to claim 20 wherein the substrate mandrel is precisely-dimensioned.

22. An amorphous non-laminar Ni/P alloy, amorphous non-laminar Ni/Co/P alloy, or amorphous non-laminar Co/P alloy article or device produced by electrodeposition of the alloy while maintaining the cathode efficiency at a range of between about 4 and about 10 mg/amp. min. and, wherein the amorphous non-laminar alloys are characterized by the absence of a plurality of thick, parallel lines or regions in cross-sectional photomicrographs of the alloys after electroplating.

23. An article or device according to claim 22 which is an amorphous non-laminar Ni/P alloy article or device.

24. An article or device according to claim 23 which is a mold.

25. An article or device according to claim 23 wherein the mold is a mold for the manufacture of compact disks or digital video disks.

* * * * *